US006868248B2

(12) United States Patent
Fukao et al.

(10) Patent No.: US 6,868,248 B2
(45) Date of Patent: Mar. 15, 2005

(54) IMAGE FORMATION APPARATUS AND A METHOD OF CONTROLLING THE IMAGE FORMATION APPARATUS

(75) Inventors: Takeshi Fukao, Tokyo (JP); Mitsuru Takahashi, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 10/197,906

(22) Filed: Jul. 19, 2002

(65) Prior Publication Data

US 2004/0013451 A1 Jan. 22, 2004

(51) Int. Cl.[7] ..... G03G 15/00
(52) U.S. Cl. ..... 399/301
(58) Field of Search ..... 399/301, 303, 399/308

(56) References Cited

U.S. PATENT DOCUMENTS

| | | | |
|---|---|---|---|
| 5,442,428 | A | 8/1995 | Takahashi et al. |
| 5,483,330 | A | 1/1996 | Ogiyama et al. |
| 5,701,566 | A | 12/1997 | Bisaiji et al. |
| 5,732,312 | A | 3/1998 | Takekoshi et al. |
| 5,870,650 | A | 2/1999 | Takahashi et al. |
| 5,890,030 | A | 3/1999 | Namekata et al. |
| 5,913,092 | A | 6/1999 | Bisaiji et al. |
| 5,983,060 | A | 11/1999 | Namekata et al. |
| 5,991,561 | A | 11/1999 | Okamoto et al. |
| 6,006,062 | A | 12/1999 | Takahashi et al. |
| 6,035,157 | A | 3/2000 | Takahashi et al. |
| 6,163,661 | A | 12/2000 | Namekata et al. |
| 6,212,351 | B1 | 4/2001 | Kawagoe et al. |
| 6,223,008 | B1 | 4/2001 | Takahashi et al. |
| 6,269,228 | B1 | 7/2001 | Kayahara et al. |
| 6,445,900 | B2 | 9/2002 | Fukao et al. |

FOREIGN PATENT DOCUMENTS

| | | | |
|---|---|---|---|
| JP | 01-145668 | | 6/1989 |
| JP | 03-260664 | | 11/1991 |
| JP | 04-158371 | | 6/1992 |
| JP | 04-220682 | | 8/1992 |
| JP | 06-289684 | | 10/1994 |
| JP | 11-190965 | | 7/1999 |
| JP | 11-212426 | * | 8/1999 |
| JP | 2000-250272 | * | 9/2000 |

OTHER PUBLICATIONS

Translation of JP 11–212426.*

* cited by examiner

*Primary Examiner*—Quana Grainger
(74) *Attorney, Agent, or Firm*—Oblon, Spivak, McClelland, Maier & Neustadt, P.C.

(57) ABSTRACT

After an image forming operation is finished, a motor that drives a belt is stopped after a predetermined time period passes since a sensor detects the only one mark provided on the belt. The predetermined time period is different for first, second and third jobs. This is repeated for the jobs thereafter. One job is a series of processing from the start of the motor to the stop of the motor. Thus, the belt stops at three different positions, for each consecutive three jobs.

12 Claims, 7 Drawing Sheets

ENLARGED VIEW OF
A PORTION D

IMAGE FORMATION APPARATUS AND A METHOD OF CONTROLLING THE IMAGE FORMATION APPARATUS

FIELD OF THE INVENTION

The present invention relates to an image formation apparatus such as a copier, a printer, or a facsimile, and a method of stopping the working of the image formation apparatus after completion of a job. More particularly, this invention relates to the image formation apparatus comprising a belt-shaped member with a mark for position detection, a sensor which detects the mark, a plurality of holding members which hold the belt-shaped member rotatably, and a drive unit that drives the belt-shaped member.

BACKGROUND OF THE INVENTION

Conventionally, there has been known an image formation apparatus using a belt-shaped member as one of its components. For example, there is one which has an intermediate transfer belt disposed opposite to a photosensitive body formed with a rotator rotatably driven, and rotated at the same peripheral speed as that of the photosensitive body, with which the belt is kept contact during the rotation. This type of image formation apparatus, which uses a method of rotating the intermediate transfer belt in one direction, has a sensor that optically detects a mark (hereafter referred to as a position detection mark) which passes under or over sensor. More specifically, the position detection mark is formed with an optically reflecting member, and it is provided on the intermediate transfer belt. This type of apparatus also comprises a charging unit, an optical writing unit, a development unit, a primary transfer unit, and a cleaning unit provided around the photosensitive body.

As a material of the intermediate transfer belt, for example, a dielectric-base organic resin film is used.

When an image is to be formed by the image formation apparatus, an image forming process is started at a predetermined timing after the detection of the position detecting mark by the detection sensor during rotation of the photosensitive body and the intermediate transfer belt. That is, optical writing to the photosensitive body is started.

When the image forming operation is finished, a drive motor which rotatably drives the intermediate transfer belt stops, thereby, the intermediate transfer belt also stops. In this case, it is programmed that the drive motor stops after a predetermined desired time since the sensor detects the position detecting mark. As a result, each time the intermediate transfer belt stops at the same position.

It is necessary that the intermediate transfer belt stops at the same position in order to keep constant a time required for outputting a first copy.

Further, in an image formation apparatus for forming color images, a toner image in a specific color is formed, by optical writing and development, on a charged area of the photosensitive body charged by passing through the charging position, and the toner image in this specific color is transferred to the intermediate transfer belt by the primary transfer unit in a primary transfer section. The image formation apparatus repeats such operations in different colors, forms a color-superimposed toner image on the intermediate transfer belt, and collectively transfers this color-superimposed toner image onto transfer paper to obtain a color image. The superimposed toner image is formed on the intermediate transfer belt with no displacement between the colors by starting the image forming process at a predetermined timing after the detection of the position detecting mark in the detection sensor in each of the different colors.

However, since the intermediate transfer belt is stretched by a plurality of holding rollers, if the intermediate transfer belt stops at the same position at any time as explained above, curl due to the holding roller may occur on a particular portion of the belt wrapped around each of the holding rollers after some time has elapsed.

When this curl occurs, a blank band may occur in an image at the time of primary transfer, which may cause the image to be failed.

To overcome that problem, Japanese Patent Application-Laid Open H06-289684 discloses an apparatus configured to have a plurality of position detecting marks on an intermediate transfer belt and allow the intermediate transfer belt to stop at a plurality of positions. In this apparatus, after cleaning of the intermediate transfer belt is finished, the sensor starts counting the number of position detecting marks having passed through a detection area, and stops the intermediate transfer belt, for example, when the sensor has counted a lower number by one than the total number of the position detecting marks printed on the intermediate transfer belt. Thus, prevention of the inconvenience may be possible.

However, in case of the apparatus disclosed in Japanese Patent Application-Laid Open H06-289684A, the cost might be increased Because a plurality of position detecting marks have to be provided on the intermediate transfer belt.

The above mentioned problem is not confined to the intermediate transfer belt, but may possibly come up in any belt-shaped member that is stretched by a plurality of holding rollers.

SUMMARY OF THE INVENTION

It is an object of this invention to provide an image formation apparatus which can achieve cost reduction and form a high-quality image by preventing curl of a belt-shaped member.

According to the present invention, the belt of the image formation apparatus is halted at a first predetermined desired position after completion of a first job, and the belt is halted at a second predetermined desired position after completion of a next job, the second position being different from the first position. In contrast, in conventional image formation apparatus, the belt is halted at the same position after completion of every job.

Other objects and features of this invention will become apparent from the following description with reference to the accompanying drawings.

DETAILED DESCRIPTION OF THE PREFERRED EMBODIMENTS

Preferred embodiments of the image formation apparatus is explained below with reference to the drawings. The image formation apparatus according to the present invention is applied in an electrophotographic color copier (hereafter called "color copier")

Figure 1:
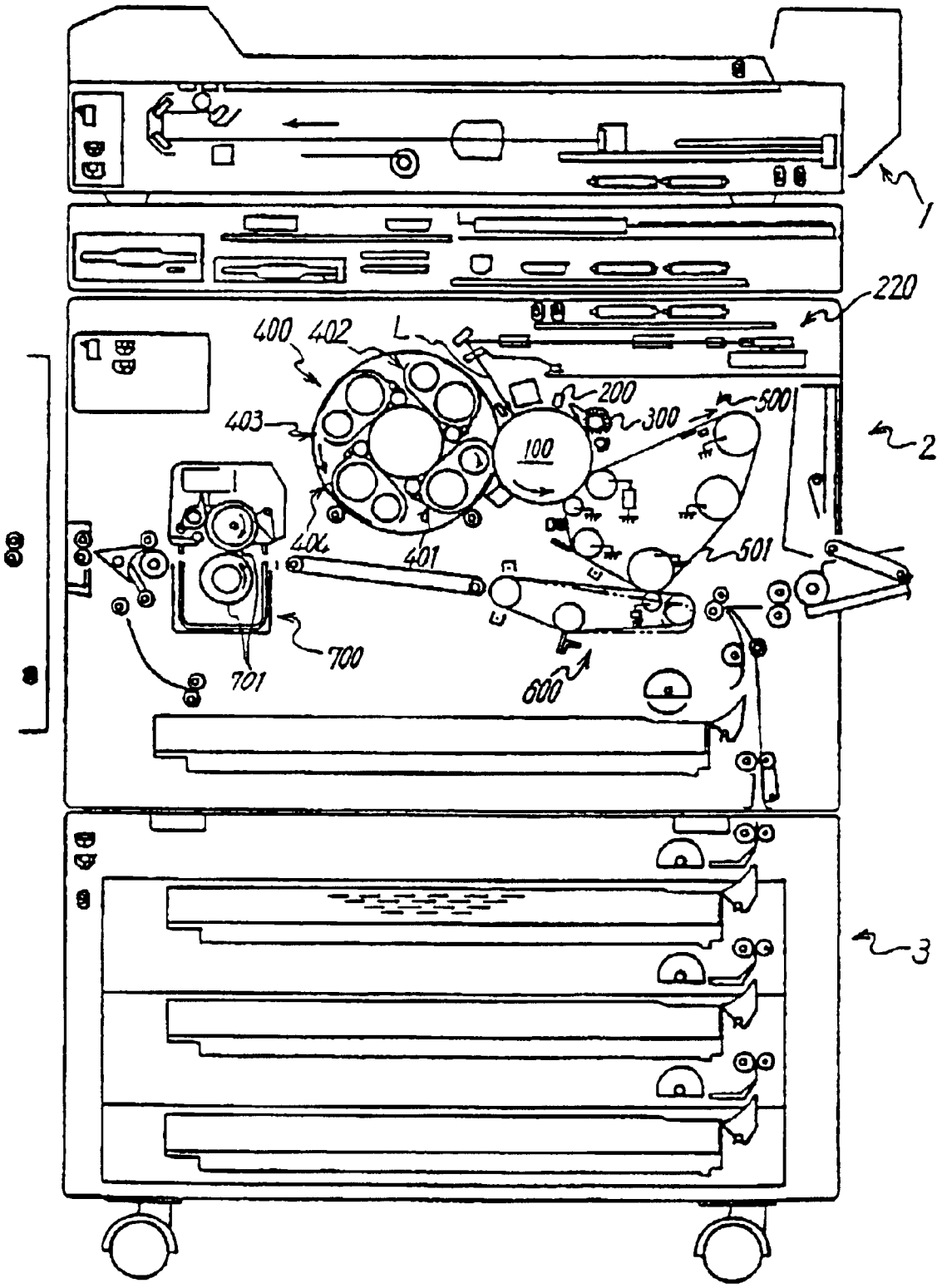
FIG. 1 is a schematic diagram of a color copier showing an example of an image formation apparatus according to an embodiment of this invention.
Figure 2:
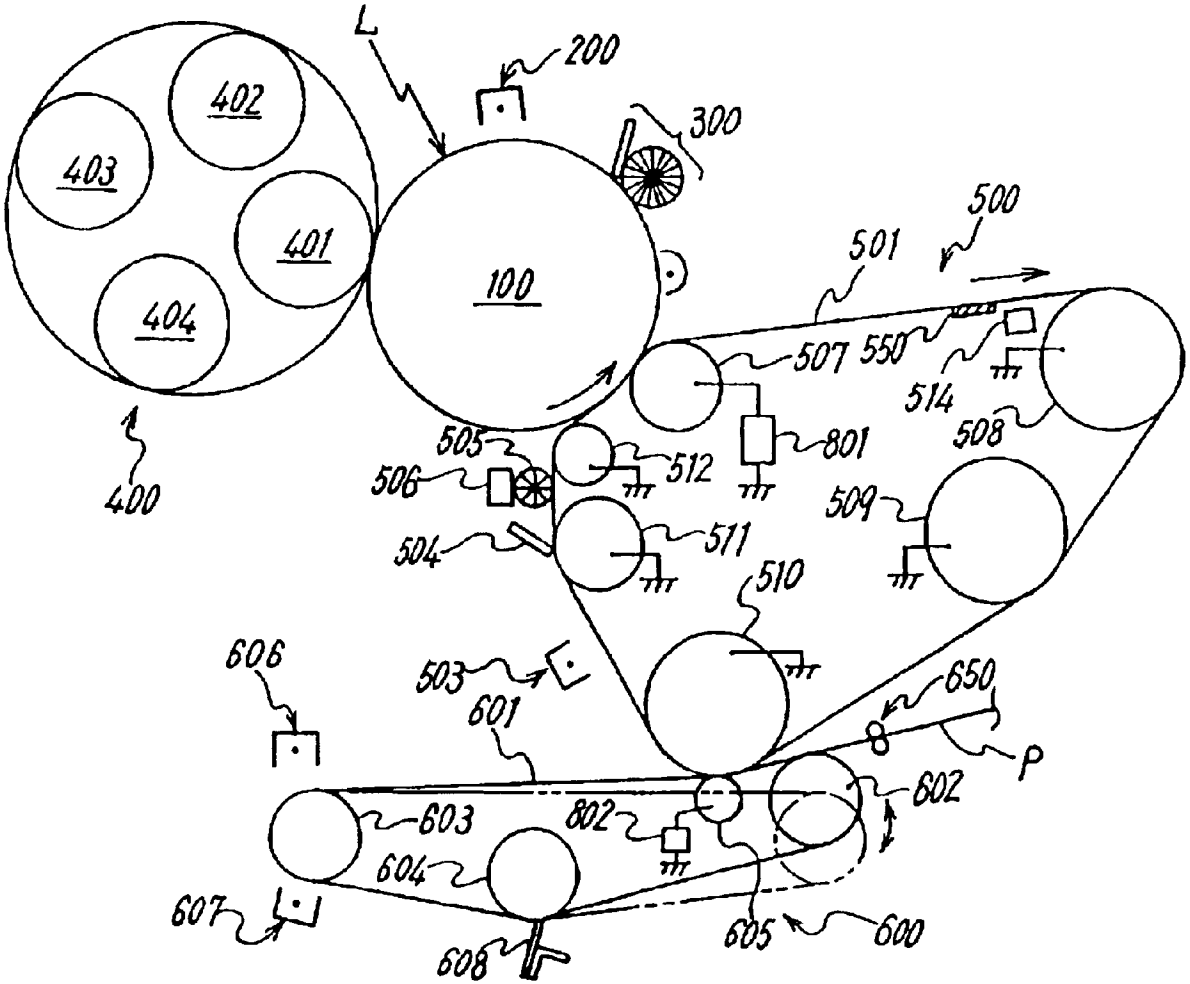
FIG. 2 shows an image formation section of the color copier.

FIG. 1 is a schematic diagram of a color copier according to this embodiment. FIG. 2 is a schematic diagram of an image formation section as a key section of the color copier.

The color copier according to this embodiment comprises, as shown in FIG. 1, a color image scanning section 1 (hereafter called "color scanner"), an image formation section 2, a paper feed section 3 and a control section for controlling driving of these sections.

The color scanner 1 scans color image information for a document in each color separation light, for example, red, green and blue (hereafter called "R", "G", and "B", respectively), and converts the information to electrical image signals. The processing for color conversion is executed in an image processing section not shown based on an intensity level of the color separation image signals of R, G, and B obtained in this color scanner to obtain image data for black, cyan, magenta, and yellow (hereafter called "Bk", "C", "M", and "Y", respectively).

The image formation section 2 comprises a photosensitive drum 100 as an image carrier, an electrifying charger 200 as a charging unit, an optical writing unit 220 as an exposure unit, a photosensitive body cleaning unit 300 consisting of a cleaning blade and fur brush, a revolver type development unit 400 as a development unit;, an intermediate transfer unit 500, a secondary transfer unit 600, and a fixture unit 700 using a fixing roller pair, 701.

The photosensitive drum 100 rotates in a counterclockwise direction as shown by an arrow in the figure. The electrifying charger 200, the photosensitive body cleaning unit 300, a selected developing device of the revolver type development unit 400, and an intermediate transfer belt 501 as an intermediate transfer body of the intermediate transfer unit 500 or the like are arranged around the photosensitive drum 100.

The optical writing unit 220 converts the color image data scanned through the color scanner 1 into optical signals, performs optical writing on the surface of the photosensitive drum 100 uniformly electrified by the electrifying charger 200 by irradiating thereon with a laser beam L corresponding to the image of the document, and forms an electrostatic latent image on the surface of the photosensitive drum 100. This optical writing unit 220 can be constructed by components such as a semiconductor laser as a light source, a laser emission driving control section, a polygon mirror and a motor for its rotation, an f/θ lens, and a reflection mirror.

The revolver type development unit 400 comprises a Bk developing device 401 using Bk toner, a C developing device 402 using C toner, an M developing device 403 using M toner, a Y developing device 404 using Y toner, and a developing revolver driving section (not shown) which rotates the overall unit in the counterclockwise direction.

Each of the developing devices 401 to 404 disposed in this revolver type development unit 400 comprises a developing sleeve as a developing material carrier which allows a nap of a developing material to be brought into contact with the surface of the photosensitive drum 100 and rotates in order to develop the electrostatic latent image, a developer paddle which rotates to suck up the developer and agitate it, and a developing sleeve driving section which rotates the developing sleeve in the clockwise direction indicated by the arrow.

In this embodiment, the toner in each of the developing devices 401 to 404 is charged to a negative polarity through its agitation with ferrite carrier. Further, a developing bias voltage is applied to each of the developing sleeves. More specifically, the developing bias voltage is obtained by superimposing an AC voltage Vac (AC component) on a negative DC voltage Vdc (DC component) by a developing bias power source as a developing bias application unit not shown. Thus, each of the developing sleeves is biased to a predetermined voltage with respect to a metal-base layer of the photosensitive drum 100.

In the standby state of the main body of the color copier, the revolver type development unit 400 stops at a home position where the Bk-developing device 401 places at a developing position. When a copy start key is pressed, scanning of image data in a document is started, and optical writing by a laser beam L, that is, formation of an electrostatic latent image is started based on the color image data (hereafter, an electrostatic latent image based on Bk image data is called "Bk electrostatic latent image". The same goes for C, M, and Y.)

In order to allow the front edge of this Bk electrostatic latent image to be first developed, rotation of the Bk developing sleeve is started before the front edge of the electrostatic latent image reaches a developing position for Bk, and the Bk electrostatic latent image is developed with Bk toner. Developing operation of the Bk electrostatic latent image is continued from then on. At the point of time at which the rear edge of the Bk electrostatic latent image has passed through the Bk developing position, the revolver type development unit 400 rotates immediately so that a developing device in a next color comes up to the developing position. This rotation should be completed, at the latest, before the front edge of the electrostatic latent image based on the next image data reaches the developing position.

The intermediate transfer unit 500 comprises an intermediate transfer belt 501 as an intermediate transfer body stretched by a plurality of rollers explained later as shown in FIG. 2. A secondary transfer belt 601' as a transfer material carrier of the secondary transfer unit 600, a secondary transfer bias roller 605 as a secondary transfer charge application unit, a belt cleaning blade 504 as an intermediate transfer body cleaning unit, and a lubricant applying brush 505 as a lubricant application unit are arranged around and opposite to this intermediate transfer belt 501.

This intermediate transfer belt 501 is stretched by a primary transfer bias roller 507 as a primary transfer charge application unit, a belt driving roller 508, a belt tension roller 509, a secondary transfer opposite roller 510, a cleaning opposite roller 511, and an earth roller 512. The rollers are formed with a conductive material and the rollers except the primary transfer bias roller 507 are grounded.

A position detecting mark 550 is provided on the internal periphery of the intermediate transfer belt 501, and the detection sensor 514 is provided in an area through which this position detecting mark 550 passes. As the detection sensor 514, for example, a reflection type of optical sensor is used. Accordingly, the image forming process is started at a predetermined timing after the detection sensor 514 detects the position detecting mark 550. More specifically, optical writing on' the photosensitive body is started.

Transfer bias controlled to a predetermined magnitude of current or voltage according to the number of superimposed toner images is applied to the primary transfer bias roller 507 by a primary transfer power source 801 controlled to a constant current or a constant voltage. The intermediate transfer belt 501 is driven in the direction of the arrow by the belt driving roller 508 which is rotatably driven in the direction of the arrow by a drive motor not shown.

Further, the intermediate transfer belt 501 has a single layer or a multilayer structure of a semiconductor or an insulator.

In a transfer section where the toner image on the photosensitive drum 100 is transferred to the intermediate transfer belt 501 (hereafter called "primary transfer section"), the intermediate transfer belt 501 is stretched by the primary transfer bias roller 507 and the earth roller 512 so as to be pressed onto the photosensitive drum 100. Thereby, a nip section with a predetermined width is formed between the photosensitive drum 100 and the intermediate transfer belt 501.

The lubricant applying brush 505 grinds zinc stearate 506 as a plate-formed lubricant and applies the ground particles onto the intermediate transfer belt 501. This lubricant applying brush 505 is so constructed as to be abuttable on the intermediate transfer belt 501 and is controlled so as to be brought into contact with the intermediate transfer belt 501 at a predetermined timing.

The secondary transfer unit 600 is formed with a secondary transfer belt 601 stretched by three supporting rollers 602, 603, and 604 or the like, and a stretched section of the secondary transfer belt 601 between the supporting rollers 602 and 603 can be pressed into contact with the secondary transfer opposite roller 510. One of the supporting rollers 602, 603, and 604 is a drive roller rotatably driven by the drive unit not shown. The secondary transfer belt 601 is driven in the direction indicated by the arrow in the figure by this drive roller.

The secondary transfer bias roller 605 is a secondary transfer unit, which is disposed so as to hold the intermediate transfer belt 501 and the secondary transfer belt 601 with the secondary transfer opposite roller 510. The secondary transfer bias roller 605 is applied with a transfer bias of a predetermined current by the secondary transfer power source 802 controlled to a constant current. Further, there is provided an abutting mechanism, not shown, which drives the supporting roller 602 and the secondary transfer bias roller 605 in the directions of the arrows so that the secondary transfer belt 601 and the secondary transfer bias roller 605 can be placed at either one of a position where these two are pressed so as to be brought into contact with the secondary transfer opposite roller 510 and a position where these two separate from the secondary transfer opposite roller 510. The secondary transfer belt 601 and the supporting roller 602 placed at the separated position are indicated by a phantom line in FIG. 2.

A resist roller pair 650 feeds transfer paper P as a transfer material at a predetermined timing in between the intermediate transfer belt 501 and the secondary transfer bell 601 sandwiched and held by the secondary transfer bias roller 605 and the secondary transfer opposite roller 510.

A transfer paper discharge charger 606 as a transfer material discharging unit and a belt discharge charger 607 as a transfer material carrier discharging unit are disposed on opposite sides of a portion of the secondary transfer belt 601 stretched by the supporting roller 603 provided on the side of the fixing roller pair 701. Further, a cleaning blade 608 as a transfer material carrier cleaning unit contacts a portion of the secondary transfer belt 601 stretched by the supporting roller 604 in the lower side of the figure.

The transfer paper discharge charger 606 discharges the charge held on the transfer paper so as to enable satisfactory separation of the transfer paper from the secondary transfer belt 601 using the stiffness of the transfer paper itself. The belt discharge charger 607 eliminates the charge remaining on the secondary transfer belt 601. The cleaning blade 608 performs cleaning by removing deposition deposited on the surface of the secondary transfer belt 601.

In this color copier, when an image forming cycle is started, the photosensitive drum 100 is rotated by the drive motor not shown in the counterclockwise direction indicated by the arrow, while the intermediate transfer belt 501 is rotated by the belt driving roller 508 in the clockwise direction indicated by the arrow. With rotation of the intermediate transfer belt 501, primary transfer of a formed Bk-toner image, a formed C-toner image, a formed M-toner image, and a formed Y-toner image is performed by a transfer bias based on a voltage applied to the primary transfer bias roller 507. The toner image is finally formed by superimposing the images on one another in order of Bk, C, M, and Y on the intermediate transfer belt 501.

For example, formation of the Bk toner image is performed as follows. The electrifying charger 200 uniformly electrifies the surface of the photosensitive drum 100 with a negative charge to a predetermined potential by corona discharge. Raster exposure by a laser beam is executed based on a Bk color image signal by the optical writing unit not shown. When this raster image is exposed, the charge proportional to the light amounts for exposure is eliminated in the exposed portion on the surface of the photosensitive drum 100 which has been uniformly electrified in the initial stage, and a Bk electrostatic latent image is formed.

Bk toner negatively charged on the Bk developing roller of the Bk developing device 401 is put into contact with this Bk electrostatic latent image, so that the toner is not deposited on the portion where the charge remains on the photosensitive drum 100, but the toner is absorbed to the portion with no charge, that is, the exposed portion, and a Bk toner image similar to the electrostatic latent image is formed. The Bk toner image formed on the photosensitive drum 100 is transferred onto the surface of the intermediate transfer belt 501 which is driving at an equal velocity to the photosensitive drum 100 in a state of contacting the drum 100. Hereafter, transfer of a toner image from the photosensitive drum 100 to the intermediate transfer belt 501 is called "transfer to the belt".

A slight amount of residual toner, which has not been transferred, remaining on the surface of the photosensitive drum 100 after the transfer to the belt, is cleaned by the photosensitive body cleaning unit 300 for reusing the photosensitive drum 100.

On the photosensitive drum 100 side, the processing proceeds from a step of Bk image formation to a next step of C image formation, where the color scanner starts scanning C image data at a predetermined timing. By performing laser-beam writing based on the C image data, a C electrostatic latent image is formed on the surface of the photosensitive drum 100.

The revolver type development unit 400 is rotated after the rear edge of the Bk electrostatic latent image has passed and before the front edge of the C electrostatic latent) image reaches, and the C developing device 402 is set to a developing position, where the C electrostatic latent image is developed with C toner.

From then on, development is continued over the area of the C electrostatic latent image, and at the point of time the rear edge of the C electrostatic latent image has passed, the revolver type development unit rotates in the same manner as the previous case of the Bk developing device 401 to allow the M developing device 403 to move to the developing position. This operation is also completed before the front edge of an M electrostatic latent image reaches the developing position.

As for M and Y image forming steps, the operations of scanning respective color image data, the formation of electrostatic latent images, and their development are the same as those of Bk and C, therefore, explanation of the steps is omitted.

Bk, C, M, and Y toner images sequentially formed on the photosensitive drum 100 are successively registered in the same plane and transferred onto the intermediate transfer belt 501. Accordingly, the toner image whose four colors at the maximum are superimposed on one another is formed on the intermediate transfer belt 501.

The transfer paper P is fed from the paper feed section such as a transfer paper cassette or a manual feeder tray not shown at the time when the image forming operation is started, and waits at the nip of the resist roller pair 650. The resist roller pair 650 is driven so that the front edge of the transfer paper P just meets the front edge of the toner image when the front edge of the toner image on the intermediate transfer belt 501 is about to reach a secondary transfer section where the nip is formed by the secondary transfer opposite roller 510 and the secondary transfer bias roller, and registration is performed between the transfer paper P and the toner image.

The transfer paper P is superimposed on the toner image on the intermediate transfer belt 501 and passes through the secondary transfer section. During this passage, the four-color superimposed toner image on the intermediate transfer belt 501 is collectively transferred onto the transfer paper by transfer bias due to the voltage applied to the secondary transfer bias roller 605 by the secondary transfer power source 802.

When passing through the opposite section to the transfer paper discharge charger 606 disposed on the downstream side from the secondary transfer section in the direction to which the secondary transfer belt 601 moves, the transfer paper P is discharged, separated from the secondary transfer belt 601, and sent to the fixing roller pair 701.

The toner image is fused into place at the nip section of this fixing roller pair 701, sent to the outside f the main body of the apparatus by an ejection roller pair not shown, and stuck with its top surface upward in a copy tray not shown, and its full color copy is then obtained.

On the other hand, the surface of the photosensitive drum 100 after the transfer to the belt is cleaned by the photosensitive body cleaning unit 300, and is uniformly discharged by a discharge lamp not shown in the figure. The toner remaining on the surface of the intermediate transfer belt 501, after the toner image is transferred to the transfer paper P, is cleaned by the belt cleaning blade 504 pressed onto the intermediate transfer belt 501 by the abutting mechanism not shown in the figure.

When doing a repeat of copying, the operation of the color scanner and the formation of the image to the photosensitive drum 100 are performed by proceeding the processing from the step of image formation in the fourth color (Y) for a first sheet to the step of image formation in the first color (Bk) for a second sheet at a predetermined timing. In the intermediate transfer belt 501, following the step of collectively transferring a four-color superimposed toner image for the first sheet to the transfer paper, a Bk toner image for the second sheet is transferred to an area of the intermediate transfer belt 501 whose surface is cleaned by the belt cleaning blade 504. From then on, the same operation as that of the first sheet is performed.

Up to this point, the copy mode to obtain a full color copy in four colors is explained, but in a case of a three-color copy mode or a two-color copy mode, the same operation is performed as that in specified colors and by a number of times.

In a case of a monochrome copy mode, only a developing device in a specified color of the revolver development unit 400 is set to a state of its developing operation, and copying operation is performed by keeping the belt cleaning blade 504 pressed to the intermediate transfer belt 501 during that period until a specified number of sheets to be copied is finished.

Figure 3A:
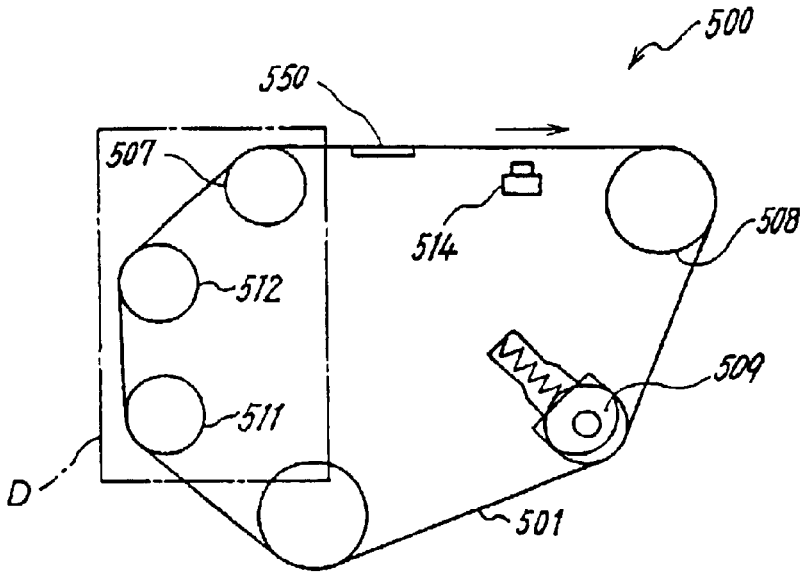
FIG. 3A shows an intermediate transfer unit.
Figure 3B:
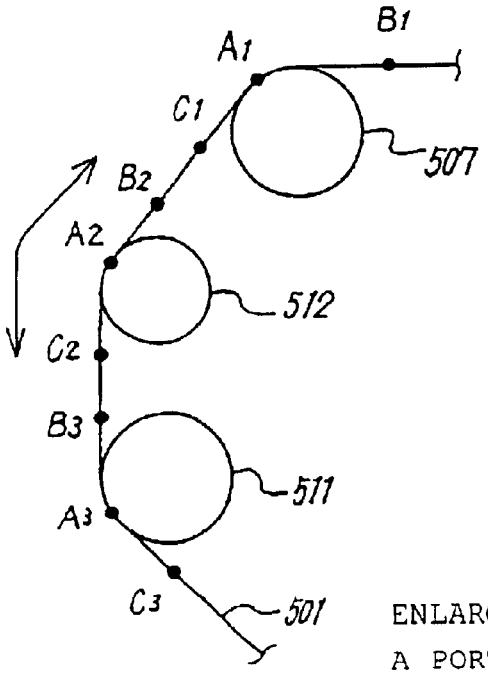
FIG. 3B is an enlarged view of a portion where curl may most possibly occur (a portion D surrounded by alternate long and short dashed lines in FIG. 3A)

A feature section of this embodiment is explained below. FIG. 3A is a schematic diagram of the intermediate transfer unit 500. FIG. 3B is an enlarged view of a portion where curl may most possibly occur (the portion D surrounded by alternate long and short dashed lines in FIG. 3A) in the intermediate transfer belt 501. In FIG. 3B, assuming that the intermediate transfer belt 501 is placed at an ordinary stop position, intermediate points of portions where the intermediate transfer belt 501 wraps the rollers of the bias roller 507, the earth roller 512, and the cleaning opposite roller 511 are stop positions A1, A2, and A3, respectively.

In the conventional color copier, after image formation is finished and cleaning of the intermediate transfer belt 501 is finished, the drive motor not shown is stopped after a predetermined time period has passed since the detection sensor 514 has detected the position detecting mark 550. Therefore, the intermediate transfer belt 501 always stops at the same stop position A. The intermediate transfer belt 501 is always put under tension by the tension roller 509, therefore, the stop positions A1, A2, and A3 are stretched and pulled by the rollers during halts of the intermediate transfer belt 501. Thus, curl occurs on the portions of the stop positions A1, A2, and A3. It has been seen that this curl tends to get worse when the intermediate transfer belt 501 has stopped for a longer time period.

Figure 4:
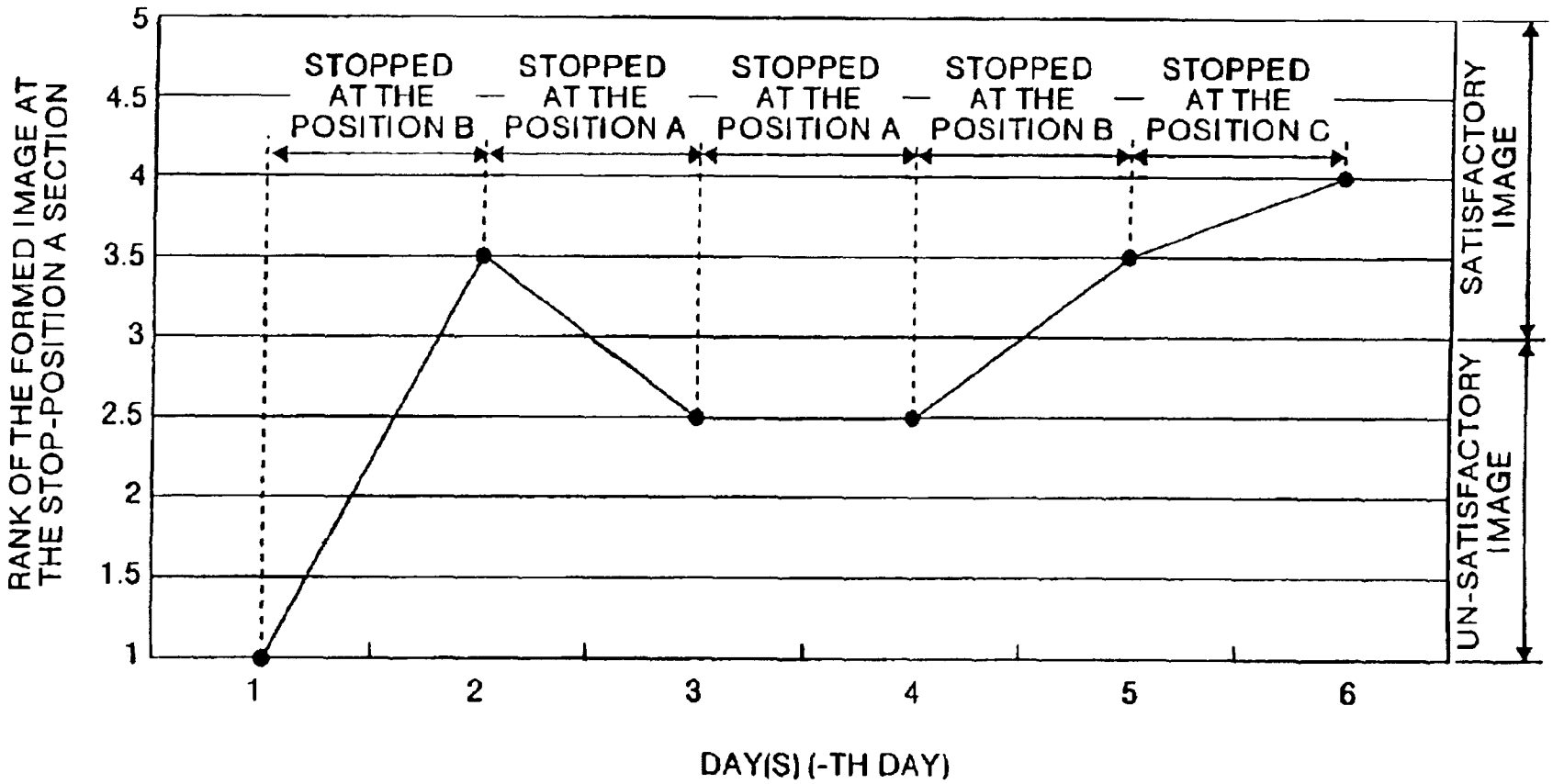
FIG. 4 is a graph showing results of experiments in which images are formed after the intermediate transfer belt has been at rest for 24 hours and the quality of the formed images is determined.

Therefore, the inventors of this invention concentrated their energies on experiments in order to straighten the curl of the belt by altering the stop position of the intermediate transfer belt 501. As stop positions, two stop positions B and C were set other than the conventional stop position A as shown in FIG. 3B. Positions displaced by 12.5 mm to the downstream side in the rotating direction of the intermediate transfer belt 501 with respect to the conventional stop positions A1, A2, and A3 were set as stop positions B1, B2, and B3, respectively. Further, positions displaced by 12.5 mm to the upstream side in the rotating direction of the intermediate transfer belt 501 with respect to the conventional stop positions A1, A2, and A3 were set as stop positions C1, C2, and C3, respectively. FIG. 4 is a graph showing results of determining the quality of images, corresponding to the stop position A sections, which are formed after the curled intermediate transfer belt has been stopped at the stop position for 24 hours. Rank 3 or higher indicate that the formed images are satisfactory.

In this experiment, at first, the intermediate transfer belt 501 was stretched by the rollers, and maintained in the same halt state for about 40 days, so that curl was intentionally formed in the portion of the conventional stop position A. When an image was formed in a state where the curl occurred on the belt, the result was rank 1, which indicates that the image is failed. Subsequently, the intermediate transfer belt 501 had been stopped at the stop position B in the downstream side in its rotating direction from the conventional stop position A for 24 hours, an image was then formed, and the quality of the image was determined. As a result, rank 3.5 was obtained, which indicates that the image is satisfactory. The following were performed in the same manner as explained above. That is, the intermediate transfer belt 501 was stopped at the conventional stop position A, the conventional stop position A, the stop position B in the downstream side, and the stop position C in the upstream side for 24 hours, respectively, and the quality of each of the formed images was determined.

In this experiment, despite random alteration of the stop positions, the graph shows climbing changes, therefore, it became clear that the rank of the formed images has increased. The reason behind that is that the portion where the curl has occurred (stop-position A section) is pulled and straightened by the belt tension during halts of the belt at the place where the belt is not wrapped around the roller.

Figure 5A:
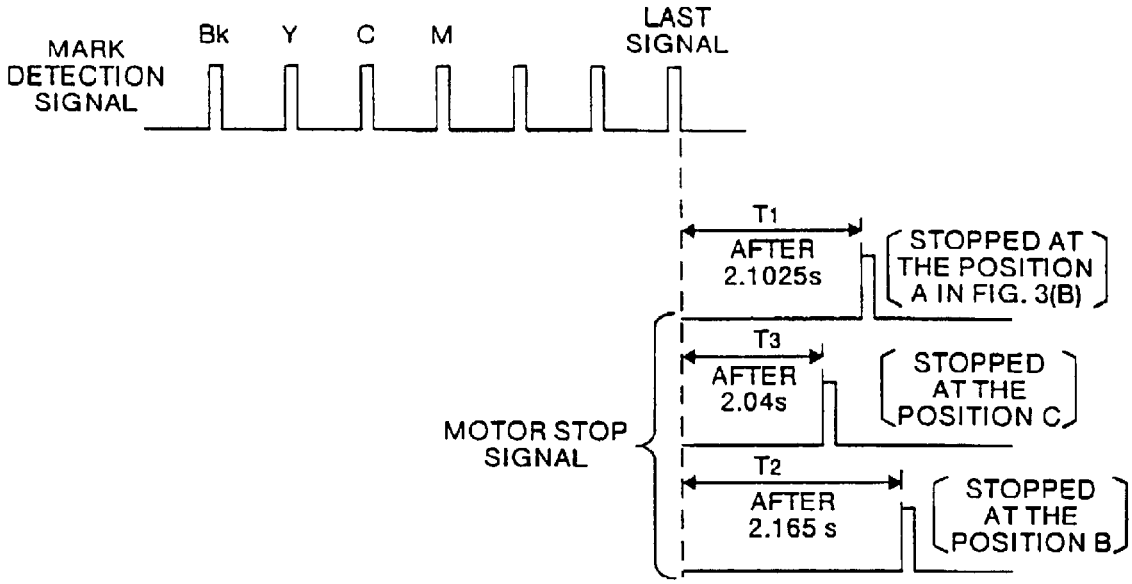
FIG. 5A is a timing chart showing a relation between each of driving-stop timers and each stop of the intermediate transfer belt.

Based on the results of these experiments, in the color copier according to this embodiment, the intermediate transfer belt 501 is designed so as to stop at a different stop position in each job. More specifically, after image formation is finished and cleaning of the intermediate transfer belt 501 is finished, by making different each period from a last signal indicating that the detection sensor 514 has detected the position detecting mark 550 till the drive motor is stop, the stop positions of the intermediate transfer belt 501 are controlled. FIG. 5A is a timing chart for explaining this configuration.

A motor stop timer T1, that stops the intermediate transfer belt 501 at the conventional stop position A, was set to 2.1025 seconds on a sequence program of a main controller. The motor stop timer T1 started measurement of a time according to the last signal, and output a motor stop signal when it counted 2.1025 seconds. In the example of the figure, a third detection signal from a detection signal indicating detection of image formation in magenta is a last signal.

Likewise, a motor stop timer T2, that stops the intermediate transfer belt 501 at the stop position B, was set to 2.165 seconds. The stop position B is 12.5 mm away from the conventional stop position A in the downstream side of the direction of rotation of the belt. Similarly, a motor stop timer T3, that stops the intermediate transfer belt 501 at the stop position C, was set to 2.04 seconds. The stop position C is 12.5 mm before the conventional stop position A in the upstream side of the direction of rotation of the belt.

Figure 5B:
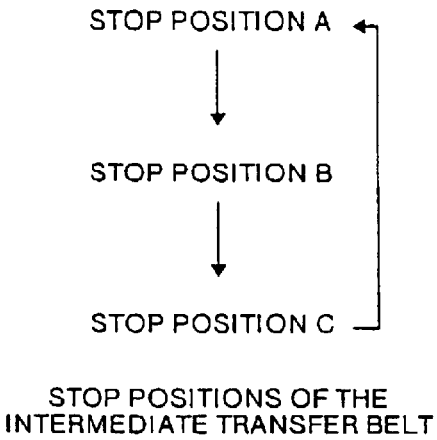
FIG. 5B shows an order of positions at which the intermediate transfer belt stops.

The sequence program was then made so that the motor stop timers T1, T2, and T3 would sequentially operate each time one job of the color copier was finished. Accordingly, as shown in FIG. 5B, it was programmed that the intermediate transfer belt 501 was sequentially stopped at the conventional stop position A, the stop position B in the downstream side, the stop position C in the upstream side, and the conventional stop position A (hereafter, repeated).

Each of the displacement of the stop position B in the downstream side and the displacement of the stop position C in the upstream side in the rotating direction of the intermediate transfer belt 501 with respect to the conventional stop position A is small, i.e. 12.5 mm (about 0.1 sec in terms of a rising time) respectively. Therefore, the time required for a first copy is hardly affected by the displacement.

As explained above, the time when the intermediate transfer belt 501 stops at a particular position can be reduced substantially to one-third, therefore, the curl of the intermediate transfer belt 501 can be prevented from its being developing. Further, even if the curl occurs on the intermediate transfer belt 501, there is an effect such that the curl is straightened.

The above-mentioned timings set in the motor stop timers T1, T2, and T3 are just examples. These timings are not to be limited to the mentioned timings. Furthermore, the intermediate transfer belt 501 is stopped at three different positions. However, the intermediate transfer belt 501 may stopped at two, four, or more than four positions. As explained above, by altering the set time or set number of the timers on the sequence program, alteration of the stop positions of the intermediate transfer belt 501 or increase or decrease in the number of places to be stopped can easily be performed.

Further, by storing the previous stop history (e.g., which motor stop timer of the motor stop timers T1, T2, and T3 has operated) in a nonvolatile IC memory such as a flash memory or a ferroelectric memory (FRAM), the previous stop history can be stored even when the main switch of the color copier is turned off. An image is then formed by turning on the main switch of the color copier, and when first one job is finished, the intermediate transfer belt 501 is stopped at a position different from the previous stop position. As explained above, the intermediate transfer belt 501 can be stopped at different positions before and after the main switch of the color copier is turned on/off. Particularly, in the case where curl of the intermediate transfer belt 501 has occurred Because a long time period has passed since the main switch is turned off until it is tuned on again, the curl can be straightened.

Further, the intermediate transfer belt 501 can be stopped at a plurality of different positions without having to set a plurality of the motor stop timers on the sequence program. For example, a stepping motor is used as the drive motor of the intermediate transfer belt 501, and by stopping the stepping motor based on the result of detection (last signal) in the detection sensor 514, the belt can be stopped at a plurality of stop positions which are previously set.

Although the example of applying the intermediate transfer belt as the belt-shaped member is explained, the belt is not limited by the above one. Any belt-shaped member may be applicable on condition that the member has a position detecting mark.

According to this invention, one position detecting mark may be provided on the belt-shaped member, thus reducing the cost as compared to the case where plural marks are provided. Further, the belt-shaped member stops at two or more different positions, therefore, the position of the belt-shaped member stretched by the holding member when being at rest is displaced from the previous one, thus obtaining an excellent effect such that the curl of the belt-shaped member can be prevented as compared to the case where the member stops at one and the same position and a high-quality image can be formed.

Further, the belt-shaped member is not stopped at the same position on a continual basis, thus obtaining an excellent effect such that the curl can be prevented more reliably. Further, even if the curl occurs on the belt-shaped member, the next stop position is displaced from the previous position, therefore, the portion where the curl has occurred is stretched by the belt tension, thus obtaining also an excellent effect such that the curl can be straightened.

Further, the storage unit stores the position where the belt-shaped member stops at the time of turning off the power to the main body of the apparatus, thus allowing the stop position when the power is turned off and a first stop position after the power is turned on to be different from each other. Thus, obtaining an excellent effect such that the curl can be straightened even if the curl occurs Because of a long-duration stop of the main body of the apparatus.

Further, the measurement unit starts measuring a period of time based on the result of detection in the detection sensor and stops the drive unit based on the measured time period by the measurement unit, therefore, the stop positions of the belt-shaped member are allowed to be different under the sequential control. Accordingly, only alteration to the sequence program of the conventional image formation apparatus may be required, thus obtaining an excellent effect such that the cost increase can be suppressed.

Additional embodiments according to the present invention will now be described while referring to FIGS. 6 through 9. The same reference numerals and symbols are used in these figures for elements that have the same functions as those that have been explained above.

Figure 6:
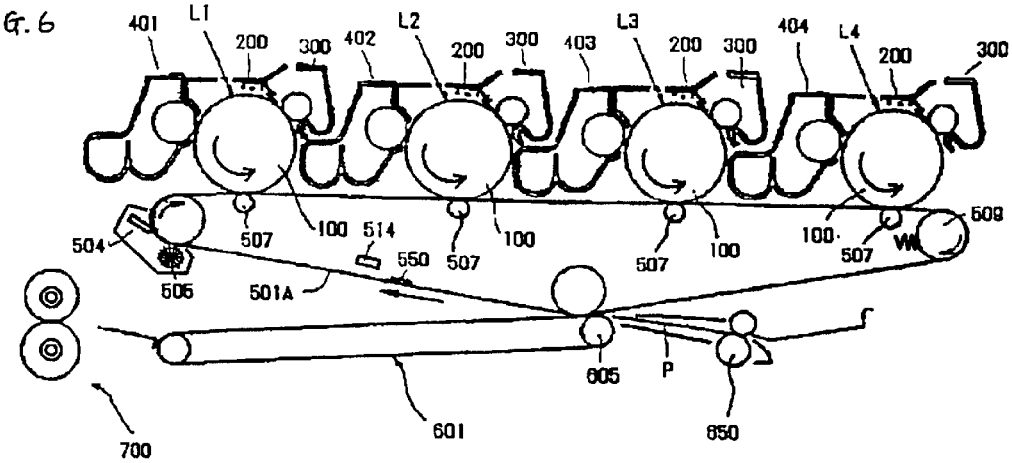
FIG. 6 is a schematic diagram showing a structure of a main part of a color image formation apparatus according to a second embodiment of this invention.

FIG. 6 is a schematic sectional diagram showing a structure of a main part of an intermediate transfer tandem color image formation apparatus according to the second embodiment of this invention.

In FIG. 6, the main part includes four photosensitive drums 100 that rotate in a direction of arrows shown, chargers 200, photosensitive drum cleaning units 300, development units 401 to 404, and an intermediate transfer belt 501A.

On a surface of each photosensitive drum 100 uniformly charged up by the charger 200, color separated optical information corresponding to an image of a document is optically written by irradiating with a laser beam L to form an electrostatic latent image on the surface. Each development unit has a toner of a different color. The electrostatic latent image is developed with the toners of the colors corresponding to the optical information. The developed images of different colors are sequentially superimposed onto and carried on a surface of the intermediate transfer belt 501A by primary transfer bias rollers 507, the intermediate transfer belt 501A moving in a direction of an arrow shown in synchronization with rotations of the photosensitive drums 100.

The images of the four toner colors superimposed on the surface of the intermediate transfer belt are then transferred at once by a secondary transfer roller 605 and a belt 601, onto a surface of a paper P fed in appropriate timing by resist rollers 650. The transferred images are then fixed by the fixing unit 700.

Figure 7:
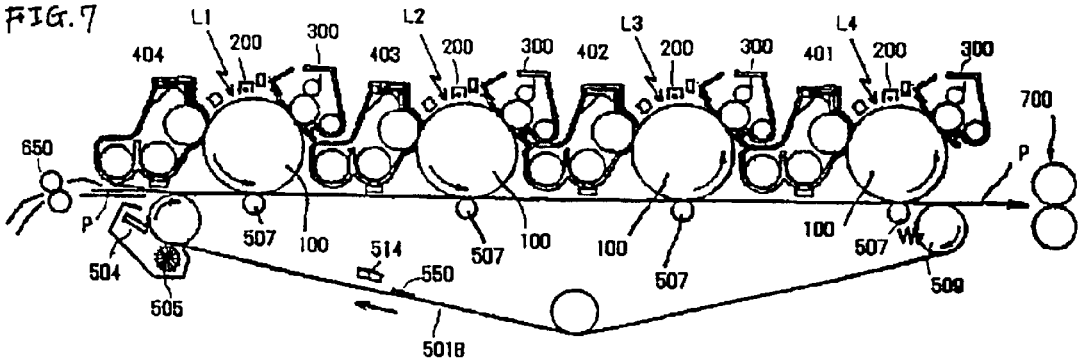
FIG. 7 is a schematic diagram showing a structure of a main part of a color image formation apparatus according to a third embodiment of this invention.

FIG. 7 is a schematic diagram showing a central structure of a main part of a direct transfer tandem color image formation apparatus according to a third embodiment of this invention. The main part in FIG. 7 includes a conveyor belt 501B instead of the intermediate transfer belt 501A in FIG. 6.

A method of forming a toner image on photosensitive drums 100 shown in FIG. 7 is the same as that shown in FIG. 6. However, a transfer method of sequentially superimposing toner images of different color toners onto a paper P fed through resist rollers 650 in FIG. 7 is different from that in FIG. 6. That is, according to FIG. 7, the toner images are directly transferred onto the paper P by bias rollers 507, and not via an intermediate transfer belt.

In both FIGS. 6 and 7, the toners remaining on the surface of the belt after the images have been transferred onto the paper are scraped off by a cleaning unit having a brush 505 and a blade 504. The belts 501A and 501B are made of a material including rubber or polyimide resin as a base substance, in which curl tends to occur.

Figure 8:
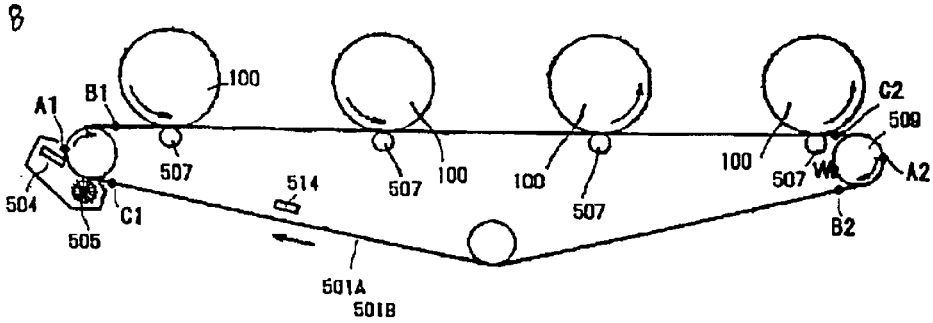
FIG. 8 is a diagram showing where curl may occur in a belt shaped member shown in FIG. 6 or 7 and positions at which the belt shaped member stops.

FIG. 8 shows the belt 501A or 501B in its stretched state. Curl is most likely to occur in portions of the transfer belt 501A or the conveyor belt 501B that wrap tension rollers 509 on both ends shown in FIG. 8. Midpoints of the portions wrapping the tension rollers 509 are referred to as stop positions A1 and A2 corresponding to a stop position A at which the belt is stopped in the conventional image formation apparatus.

In conventional apparatus, a drive motor (not shown) is stopped after a predetermined period of time from the moment a sensor 514 detects a position detection mark 550, after image formation and cleaning of the belt 501A or 501B have been completed. The belt 501A or 501B always stops at the same stop position A. Since there is always a tension in the belt 501A or 501B caused by the tension rollers 509, the stop positions Al and A2 are always in a pulled state stretched around the tension rollers 509, while the belt 501A or 501B is stopped. Accordingly, curl occurs at stop positions A1 and A2. The curl tends to worsen when the belt 501A or 501B stops for a longer period of time.

Therefore, in an attempt to reduce the curl, experiments were carried out with the second and the third embodiments in which the belts 501A and 501B were stopped at different positions. Extra stop positions B1, B2 and C1, C2 in addition to the conventional stop positions A1 and A2 as shown in FIG. 8 were tested. The stop positions B1 and B2 were set at positions displaced by 20 mm downstream in the direction the belt rotated with respect to the conventional stop positions A1 and A2 respectively. The stop positions C1 and C2 were set at positions displaced by 20 mm upstream in the direction the belt rotated with respect to the conventional stop positions A1 and A2 respectively.

As already explained in relation to FIG. 4, quality of the image formed after the curled belt has been stopped at each of the stop positions for 24 hours was determined and represented by a rank. A rank 3 or higher indicated that the formed image was satisfactory.

The belt 501A or 501B was set around the rollers, and maintained in a halt state for approximately 40 days, so that curl was intentionally formed in the portions at the conventional stop positions A1 and A2. When an image was formed using the belt with the curl, the rank was 1, which indicated that the image was unsatisfactory.

Subsequently, the belt 501A or 501B was stopped at the stop positions B1 and B2 for 24 hours. Image formation was then carried out and a quality of the image was determined.

As a result, the rank was 3.5, which indicated that the image was satisfactory.

Other stop positions were then tested as explained above. That is, the belt was stopped at the conventional stop position A, the conventional stop position A, the stop position B downstream, and the stop position C upstream for 24 hours each and the quality of the image formed after each stop was determined. In this experiment, although the stop positions were changed randomly, the rank of the image formed increased over time. The increase in the rank was probably achieved Because the curled portions or stop positions A1 and A2 were stretched by a belt tension while the belt is stopped at a position where the curled portions are not wrapped around the rollers.

Based on the results of the experiments, the apparatuses according to the second and third embodiments are designed such that the belt 501A or 501B stops at a different position for each job. More specifically, a period of time between a generation of a last signal indicating detection of the position detection mark 550 by the sensor 514 after image formation and cleaning of the belt 501A or 501B have been completed, and the moment the drive motor is stopped, is varied. As a result, the stop positions of the belt 501A or 501B can be controlled.

A timing chart indicating the period varied, and a method of controlling the stop positions according to the second or the third embodiments is the same as the first embodiment as shown in FIG. 5A.

Figure 9:
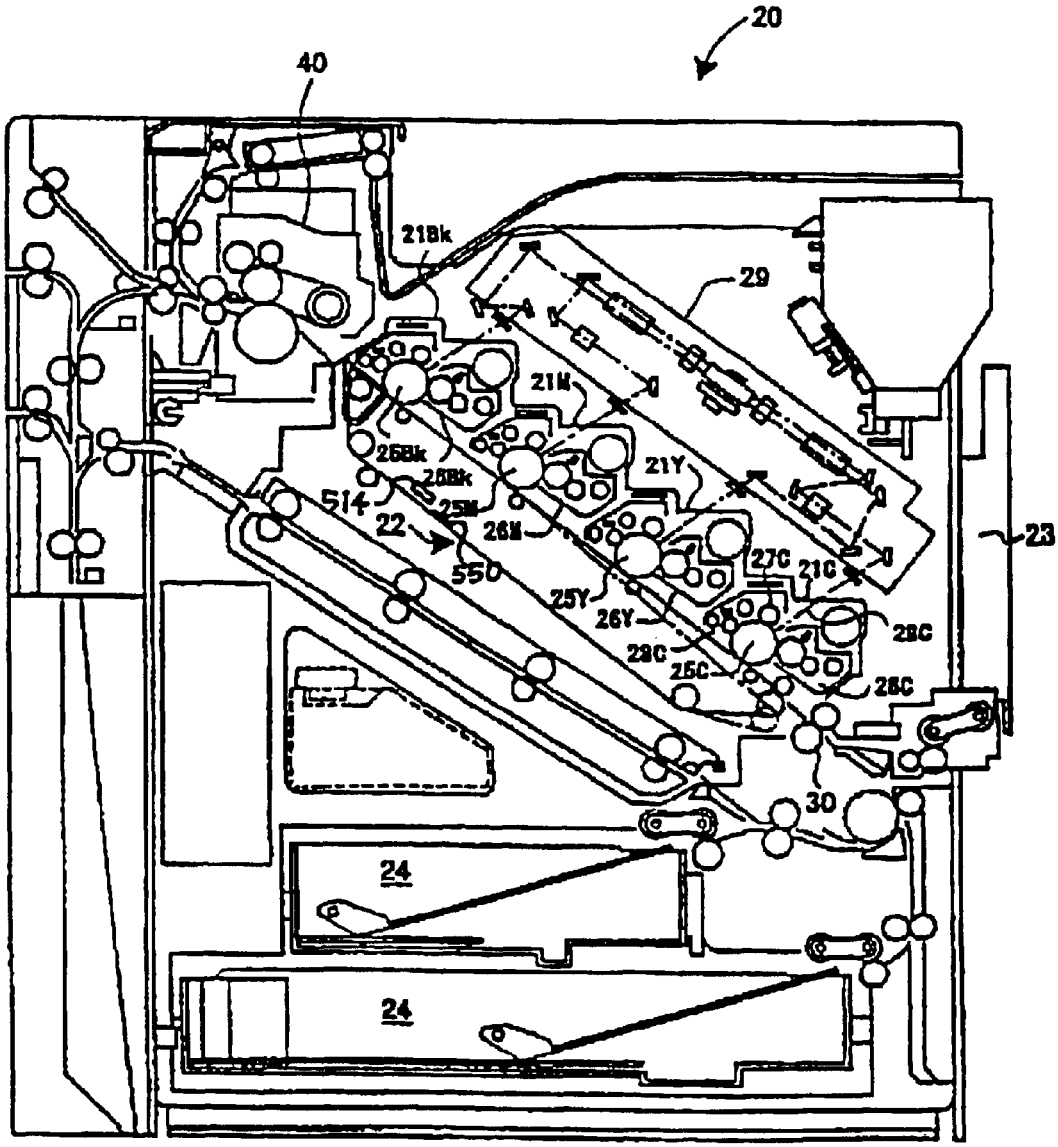
FIG. 9 is a schematic diagram showing a structure of a full color image formation apparatus according to a fourth embodiment of this invention.

FIG. 9 is a schematic diagram showing a structure of a full color image formation apparatus according to a fourth embodiment of this invention.

In FIG. 9, the full color image formation apparatus 20 includes image formation units 21C, 21Y, 21M, and 21BK, each forming an image of a different color in accordance with an original image. A transfer section 22 is positioned opposite to the image formation units. A manual feeder tray 23 functions as a sheet medium feeder feeding various sheet media to a transfer region between the image formation units and the transfer section 22 opposing each other. A sheet cassette 24, resist rollers 30 which feed the sheet medium conveyed from the manual feeder tray 23 or the sheet cassette 24 at a timing according to image formation executed by the image formation units 21C, 21Y, 21M, and 21BK, and a fixing device 40 that fixes the sheet material onto which the image has been transferred in the transfer region are also provided in the image formation apparatus 20.

Plain paper generally used for photocopying, overhead projector films, cards, 90K paper such as postcards, cardboard of approximately 100 g/m$^2$ or greater, and special sheets such as envelopes having a heat capacity larger than that of paper, may be used as the sheet medium.

The image formation units 21C, 21Y, 21M, and 21BK each develops an image of cyan, yellow, magenta or black respectively. All the image formation units have a same configuration except for a color of a toner. Thus, the configuration of only the image formation apparatus 21C will be described in detail as an example.

The image formation unit 21C has a photosensitive drum 25C as an electrostatic latent image carrier having a thin-walled cylindrical base body with an outside diameter of 30 mm, an inside diameter of 28.5 mm, and a peripheral wall thickness of 0.75 mm. The image formation unit 21C also has a charger 27C, a developer 26C, and a cleaner 28C, which are positioned along a rotating direction of the photosensitive drum 25C. The image is exposed by an exposure light, between the charger 27C and the developer 26C, as generally known. The transfer section 22 in the image formation apparatus 20 is placed diagonally such that a horizontal space occupied by the transfer section 22 is saved.

The image formation units are each provided as a detachable process cartridge such that the image formation units of the four colors may be pulled out at once from the image formation apparatus main body.

The charger 27C has a roller shaped core. A film having a predetermined thickness for providing a small distance between the charger 27C and the photosensitive drum 25C is wrapped around each of peripheral surfaces near both ends of the core. The charger 27C is pressured onto the photosensitive drum 25C to apply a force by springs provided on a rotation axis of the core. The film abuts against a peripheral surface of the photosensitive drum 25C such that there is a gap set between the oppositely placed charger 27C and the peripheral surface of the photosensitive drum 25C.

The charger 27C applies to the core, for example, a direct current voltage of 700 V under constant voltage control and an alternating current voltage under constant current control, in order to uniformly electrify the photosensitive drum 25C via the gap through aerial discharge.

Similar to the previous embodiments, a position detecting mark 550 is provided on an internal periphery of a belt of the transfer section 22, and a detection sensor 514 is provided in an area through which this position detecting mark 550 passes. A mechanism and functions of the position detecting mark 550 and the detection sensor 514 is the same as that of the previous embodiments.

The present document incorporates by reference the entire contents of Japanese application 2000-10440, filed on Jan. 19, 2000.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. An image formation apparatus, comprising:

a belt-shaped member having only one mark to be used for position detection;

a mark sensor configured to detect said mark on said belt-shaped member;

a plurality of holding members, each of which is configured to rotatably hold said belt-shaped member;

a drive unit configured to drive said holding members;

a measurement unit configured to start measuring time each time said mark sensor detects said mark;

a control unit configured to control rotation and stopping of said drive unit, based on the time measured by said measurement unit, in such a manner that said belt-shaped member stops in at least two different positions;

a plurality of latent image carriers, each of which is configured to form a latent image of a decomposed image on a surface of a respective latent image carrier; and a plurality of development units configured to develop the latent image using a developer provided in a respective development unit;

wherein the belt-shaped member is configured to function as an intermediate transfer body that contacts the latent image carriers, and on which a composed image is formed, by transferring and composing successively-superimposed decomposed images that have been developed.

2. The image formation apparatus according to claim 1, wherein:

said control unit is configured to control said belt-shaped member so as to be stopped at a position different from a position where said belt-shaped member is at rest before being driven.

3. The image formation apparatus according to claim 2, further comprising:

a storage unit configured to store a stop position of said belt-shaped member when power to said image formation apparatus is turned off.

4. An image formation apparatus, comprising:

a belt-shaped member having only one mark to be used for position detection;

a mark sensor configured to detect said mark on said belt-shaped member;

a plurality of holding members, each of which is configured to rotatably hold said belt-shaped member;

a drive unit configured to drive said holding members;

a measurement unit configured to start measuring time each time said mark sensor detects said mark;

a control unit configured to control rotation and stopping of said drive unit, based on the time measured by said measurement unit, in such a manner that said belt-shaped member stops in at least two different positions;

a plurality of latent image carriers, each of which is configured to form a latent image of a decomposed image on a surface of a respective latent image carrier; and a plurality of development units, each developing the latent image using a developer provided in a respective development unit, wherein the belt-shaped member is configured to function as a recording medium conveyor that conveys a recording medium on which a composed image is formed, by transferring and composing the successively-superimposed decomposed images that have been developed.

5. The image formation apparatus according to claim 4, wherein:

said control unit is configured to control said belt-shaped member so as to be stopped at a position different from a position where said belt-shaped member is at rest before being driven.

6. The image formation apparatus according to claim 5, further comprising:

a storage unit configured to store a stop position of said belt-shaped member when power to said image formation apparatus is turned off.

7. An image formation apparatus, comprising:

a belt-shaped member having only one mark to be used for position detection;

a mark sensor configured to detect said mark on said belt-shaped member;

a plurality of holding members, each of which is configured to rotatably hold said belt-shaped member;

a drive unit configured to drive said holding members;

a timer configured to measure at least three predetermined desired times having different time durations, and to start measuring time each time said mark sensor detects said mark;

a control unit configured to control rotation and stopping of said drive unit, based on the time measured by said timer, in such a manner that said belt-shaped member stops in at least three different positions;

a plurality of latent image carriers, each of which is configured to form a latent image of a decomposed image on a surface of a respective latent image carrier; and a plurality of development units configured to develop the latent image using a developer provided in a respective development unit;

wherein the belt-shaped member is configured to function as an intermediate transfer body that contacts the latent image carriers, and on which a composed image is formed, by transferring and composing successively-superimposed decomposed images that have been developed.

8. The image formation apparatus according to claim 7, wherein:

said control unit is configured to control said belt-shaped member so as to be stopped at a position different from a position where said belt-shaped member is at rest before being driven.

9. The image formation apparatus according to claim 8, further comprising:

a storage unit configured to store a stop position of said belt-shaped member when power to said image formation apparatus is turned off.

10. An image formation apparatus, comprising:

a belt-shaped member having only one mark to be used for position detection;

a mark sensor configured to detect said mark on said belt-shaped member;

a plurality of holding members, each of which is configured to rotatably hold said belt-shaped member;

a drive unit configured to drive said holding members;

a timer configured to measure at least three predetermined desired times having different time durations, and to start measuring time each time said mark sensor detects said mark;

a control unit configured to control rotation and stopping of said drive unit, based on the time measured by said timer, in such a manner that said belt-shaped member stops in at least three different positions;

a plurality of latent image carriers, each of which is configured to form a latent image of a decomposed image on a surface of a respective latent image carrier; and a plurality of development units, each developing the latent image using a developer provided in a respective development unit, wherein the belt-shaped member is configured to function as a recording medium conveyor that conveys a recording medium on which a composed image is formed, by transferring and composing the successively-superimposed decomposed images that have been developed.

11. The image formation apparatus according to claim 10, wherein:

said control unit is configured to control said belt-shaped member so as to be stopped at a position different from a position where said belt-shaped member is at rest before being driven.

12. The image formation apparatus according to claim 11, further comprising:

a storage unit configured to store a stop position of said belt-shaped member when power to said image formation apparatus is turned off.

* * * * *